US011786083B2

(12) United States Patent
McCarthy

(10) Patent No.: US 11,786,083 B2
(45) Date of Patent: Oct. 17, 2023

(54) LOTION APPLICATOR

(71) Applicant: Narda McCarthy, Weston, FL (US)

(72) Inventor: Narda McCarthy, Weston, FL (US)

( * ) Notice: Subject to any disclaimer, the term of this patent is extended or adjusted under 35 U.S.C. 154(b) by 0 days.

(21) Appl. No.: 16/789,436

(22) Filed: Feb. 13, 2020

(65) Prior Publication Data

US 2021/0251434 A1 Aug. 19, 2021

(51) Int. Cl.

| | |
|---|---|
| ***A46B 5/02*** | (2006.01) |
| ***A47K 7/03*** | (2006.01) |
| ***A47K 7/02*** | (2006.01) |
| ***A45D 34/04*** | (2006.01) |

(52) U.S. Cl.

CPC ..... *A47K 7/03* (2013.01); *A45D 34/042* (2013.01); *A47K 7/022* (2013.01); *A47K 7/028* (2013.01); *A45D 2200/1045* (2013.01); *A45D 2200/1081* (2013.01)

(58) Field of Classification Search

CPC ..... A45D 2200/1081; A45D 34/042; A47K 7/03; A47K 7/022; A47K 7/028; A46B 11/002

USPC ..... 401/6, 188 R

See application file for complete search history.

(56) References Cited

U.S. PATENT DOCUMENTS

| | | | | |
|---|---|---|---|---|
| 4,171,171 | A | 10/1979 | Jones | |
| 4,889,441 | A * | 12/1989 | Tice | A45D 34/042 401/131 |
| 5,992,428 | A | 11/1999 | Goolamali | |
| 6,129,469 | A * | 10/2000 | Messer | A45D 34/042 401/6 |
| 6,210,057 | B1 | 4/2001 | Yannaci et al. | |
| 6,325,564 | B1 | 12/2001 | Knowles | |
| 6,543,954 | B2 * | 4/2003 | Owings | A45D 34/04 401/185 |
| 6,616,364 | B2 | 9/2003 | Katz et al. | |
| 6,726,385 | B1 | 4/2004 | Borowski | |
| 7,309,180 | B2 * | 12/2007 | Russell | A45D 34/041 401/1 |
| 7,478,961 | B1 * | 1/2009 | Raker | A45D 34/04 401/137 |
| 8,875,337 | B2 | 11/2014 | Tacoma | |
| 8,967,898 | B1 * | 3/2015 | Dayeh | A47K 7/028 401/188 R |
| 9,055,845 | B1 * | 6/2015 | Hooper | A47K 7/028 |
| 9,351,613 | B1 | 5/2016 | Tacoma | |
| 2009/0092435 | A1 * | 4/2009 | Stevens | A45D 34/04 401/6 |
| 2012/0039652 | A1 * | 2/2012 | Reed | A45D 40/28 401/6 |
| 2018/0160815 | A1 * | 6/2018 | Mittelstadt | B60N 2/882 |
| 2018/0160865 | A1 * | 6/2018 | Richards | A47K 7/03 |
| 2019/0343262 | A1 * | 11/2019 | Li | A45D 34/042 |

* cited by examiner

*Primary Examiner* — Jennifer C Chiang

(57) ABSTRACT

An illustrated view of an exemplary lotion applicator for applying lotion or soap to hard-to reach portions of the body is presented. The lotion applicator provides a two-piece device that can easily be washed with warm water and soap. Also, the lotion applicator is useful for gently applying lotion or soap while gently massaging the skin while applying the lotion or soap.

11 Claims, 1 Drawing Sheet

LOTION APPLICATOR

FIELD OF THE INVENTION

This invention relates to lotion. More particularly, it relates to applicators for lotions.

BACKGROUND

A lotion is a low-viscosity topical preparation intended for application to the skin. By contrast, creams and gels have higher viscosity, typically due to lower water content. Lotions are applied to external skin with bare hands, a brush, a clean cloth, or cotton wool.

While a lotion may be used as a medicine delivery system, many lotions, especially hand lotions and body lotions are meant instead to simply smooth, moisturize, soften and perhaps perfume the skin.

Some skincare products, such as sunscreen and moisturizer, may be available in multiple formats, such as lotions, gels, creams, or sprays.

An applicator is a tool or device used to apply a fluid or semi-fluid substance to a surface.

A lotion applicator is a device that, when manipulated or triggered appropriately, dispenses lotion (usually in small, single-use quantities). It can be manually operated by means of a handle or can be automatic.

When lotion is dispensed in liquid form, it is generally in a squeeze bottle or pump. The most popular lotion dispensers of this type are plastic pump bottles, many of which are disposable.

Often times applicators are difficult to maneuver and to reach hard-to-get-to places on a person's body; in particular the back. Applicators can also be rough on the skin and cause fingers of the user to ache.

In light of the foregoing, it would be desirable to devise an improved lotion applicator that reaches hard-to reach areas of a person's body. Further, it would be desirable for the lotion applicator to massage the skin of the person while evenly dispersing the lotion on the body of the person. Also, it would be desirable for the lotion applicator to ease the wear and tear on a person's fingers such that the fingers do not ache after use of the applicator.

DETAILED DESCRIPTION

Figure 1B:
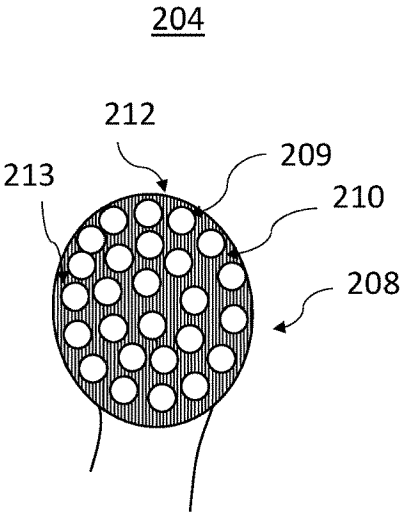
FIG. 1B is an illustrated view of a dispensing side of the lotion applicator shown in FIG. 1A.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Figure 1A:
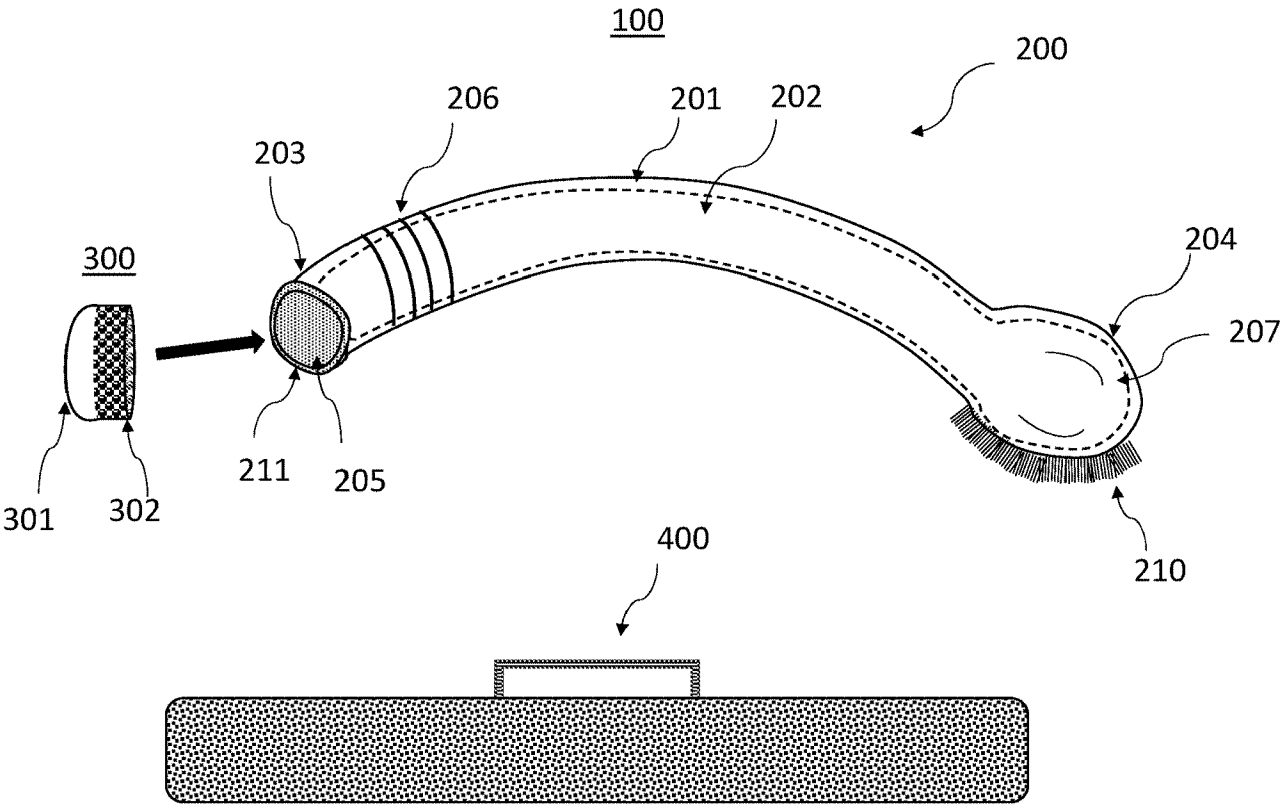
FIG. 1A is an illustrated view of an exemplary lotion applicator.

Referring to FIG. 1A and FIG. 1B, an illustrated view of an exemplary lotion applicator 100 for applying lotion or soap to hard-to reach portions of the body is presented. The lotion applicator 100 provides a two-piece device that can easily be washed with warm water and soap. Also, the lotion applicator 100 is useful for gently applying lotion or soap while gently massaging the skin while applying the lotion or soap.

The lotion applicator 100 has a body 200. Additionally, the lotion applicator has a pump 300. The body 200 preferably has a length between thirteen and fifteen (13-15) inches, however other lengths are hereby contemplated, including, but not limited to, twelve (12) inches, sixteen (16) inches, etc. The body 200 preferably has a diameter of one (1) inch, however other diameters are hereby contemplated, including, but not limited to, three-fourth (0.75) inches, one and one-fourth (1.25) inches, etc. The body 200 is preferably hollow.

The body 200 has an outside 201, an interior 202, a top 203 and a head 204. The top 203 has an opening 211 and a cap 205. The cap 205 is removable. The cap 205, when coupled to the top 203 of the body 200, prevents lotion or soap from spilling out of the interior 202 of the body 200. Lotion and/or soap is entered into the interior 202 of the body 200 through the opening 211 of the top 203 of the body 200.

The pump 300 has a pump end 301 and a connecting end 302. The pump end 301 projects outward or convexly. The pump end 301 is pressed to apply pressure to the lotion and push the lotion to the head 204. When the connecting end 302 of the pump 300 is coupled to the opening 211 of the top 203 of the body, the cap 205 is not in use. Further, the pump 300 provides for moving the lotion/soap through the interior 202 of the body 200 and into the head 204 for application to the desired area of the body.

One or more grabbing dents 206 on the outside 201 of the body 200 are substantially near the top 203 of the body 200. The one or more grabbing dents 206 provide a grip for the user such that the lotion applicator 100 is under control and a user's fingers are not stressed such that the fingers do not ache from use of the lotion applicator 100.

The body 200 is preferably made of a soft material, such as plastic, but may be made of other materials as desired. The body 200 is preferably rigid. The body 200 is preferably curved. A soft bag 400 is optionally and/or additionally used to store the lotion applicator 200.

The head 204 is preferably oval in shape. The head 204 has a top 207 and a bottom 208. The top 207 may be flat, concave, cultured, etc. The bottom 207, shown in detail in FIG. 1B, has a plurality of dispensing holes 209 and a plurality of bristles 210. The bristles 210 are preferably made of a silicone material, however other materials are hereby contemplated and may be used alternatively as desired.

The plurality of bristles 210 cover a center 213 of the bottom 208 of the head 204 of the body 200. Further the center 213 also has the plurality of dispensing holes 209 to dispense the lotion or soap as the lotion applicator 100 is in use. Therefore, the center 213 has both the plurality of bristles 210 and the plurality of dispensing holes 209 interspersed.

The lotion or soap is entered through the opening 211 at the top 203 of the body 200 and is contained in the interior 202 of the body 200. The lotion or soap flows into the head 204 of the body 200 and is dispensed through the dispensing holes 209 at the bottom 208 of the head 204 of the body 200. As the lotion or soap is being dispensed, the plurality of bristles 210 gently massage the skin and evenly distribute the lotion or soap on the skin. The lotion applicator 100 can be easily cleaned with warm water and soap.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A lotion applicator for applying lotion or soap to hard-to reach portions of a person's body, the applicator consisting of:

a body, the body comprising:

a top, the top having an opening and a cap;

an outside, the outside having one or more grabbing dents substantially near the top of the body;

a pump, the pump having a pump end and a connecting end, wherein the connecting end of the pump being coupled to the opening of the top of the body, and wherein the pump end being protruding outward;

a soft bag, wherein the soft bag for storing the applicator;

an interior, the interior being for storing the lotion or the soap; and a head, the head having a top and a bottom, wherein the bottom having a center, wherein the center of the bottom having a plurality of bristles and a plurality of dispensing holes interspersed.

2. The applicator of claim 1, wherein the body having a length being between thirteen and fifteen (13-15) inches.

3. The applicator of claim 1, wherein the body having a diameter being one (1) inch.

4. The applicator of claim 1, wherein the body having a shape being curved.

5. The applicator of claim 1, wherein the body being rigid.

6. The applicator of claim 1, wherein the body being made of a plastic material.

7. The applicator of claim 1, wherein the cap being removable from the opening of the top of the body.

8. The applicator of claim 1, wherein the interior of the body being hollow.

9. The applicator of claim 1, wherein the bristles being made of a silicone material.

10. The applicator of claim 1, wherein the head having a shape being oval.

11. A lotion applicator for applying lotion or soap to hard-to reach portions of a person's body, the applicator consisting of:

a body, the body comprising:

a top, the top having an opening and a cap, wherein the cap being removable from the opening of the top of the body;

an outside, the outside having one or more grabbing dents substantially near the top of the body;

a pump, the pump having a pump end and a connecting end, wherein the connecting end of the pump being coupled to the opening of the top of the body, and wherein the pump end being protruding outward;

a soft bag, wherein the soft bag for storing the applicator;

an interior, the interior being for storing the lotion or the soap, wherein the interior of the body being hollow; and a head, the head having a top and a bottom, wherein the bottom having a center, wherein the center of the bottom having a plurality of bristles and a plurality of dispensing holes interspersed, wherein the head having a shape being oval, wherein the bristles being made of a silicone material, wherein the body being rigid, wherein the body being made of a plastic material, wherein the body having a length being between thirteen and fifteen (13-15) inches, wherein the body having a diameter being one (1) inch, wherein the body having a shape being curved.

* * * * *